US008116654B2

(12) United States Patent
Suzuki

(10) Patent No.: US 8,116,654 B2
(45) Date of Patent: Feb. 14, 2012

(54) IMAGE HEATING APPARATUS

(75) Inventor: Ryo Suzuki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 372 days.

(21) Appl. No.: 12/406,557

(22) Filed: Mar. 18, 2009

(65) Prior Publication Data

US 2009/0245848 A1 Oct. 1, 2009

(30) Foreign Application Priority Data

Mar. 27, 2008 (JP) ..... 2008-082446

(51) Int. Cl.
*G03G 21/20* (2006.01)

(52) U.S. Cl. ..... 399/92; 399/93

(58) Field of Classification Search ..... 399/91–93, 399/67–69, 122, 320, 328–330; 219/216, 219/619

See application file for complete search history.

(56) References Cited

U.S. PATENT DOCUMENTS

| | | | | |
|---|---|---|---|---|
| 7,421,219 | B2 | 9/2008 | Matsuura et al. | 399/45 |
| 7,433,625 | B2 * | 10/2008 | Yamaoka et al. | 399/92 |
| 7,536,145 | B2 * | 5/2009 | Tomine et al. | 399/328 |
| 2007/0059021 | A1 | 3/2007 | Hanashi et al. | 399/92 |
| 2008/0013981 | A1 | 1/2008 | Kimura et al. | 399/96 |

FOREIGN PATENT DOCUMENTS

| | | |
|---|---|---|
| JP | 60-136779 | 7/1985 |
| JP | 2002-287564 | 10/2002 |
| JP | 2007-79033 | 3/2007 |
| JP | 2007-79035 | 3/2007 |
| JP | 2008-15049 | 1/2008 |

* cited by examiner

*Primary Examiner* — Hoan Tran

(74) *Attorney, Agent, or Firm* — Fitzpatrick, Cella, Harper & Scinto

(57) ABSTRACT

An image heating apparatus includes a heating rotor which heats a toner image while nipping and conveying a recording material on which the toner image is borne, a fan which cools the heating rotor, a blowing port which is arranged facing the heating rotor and through which blowing air passes from the fan toward the heating rotor, and a shutter which is movable in the longitudinal direction of the heating rotor so as to change opening area of the blowing port, wherein the shutter is moved in the longitudinal direction while rotating the fan after heating operation of the heating rotor to the toner image is completed.

4 Claims, 11 Drawing Sheets

| | W/2 < X | X < W/2 < Y | W/2 > Y |
|---|---|---|---|
| ~ X | V1 | | |
| X ~ Y | V2 | V2 | |
| Y~CLOSED | V3 | V3 | V3 |

SHUTTER MOVEMENT SPEED RELATIONS IS AS FOLLOWS:
V1 > V2, V3 > V2

| | ~ 50 SHEETS | 51~200 SHEETS | 201 SHEETS ~ |
|---|---|---|---|
| ~ X | V1 | V1' | V1" |
| X ~ Y | V2 | V2' | V2" |
| Y~CLOSED | V3 | V3' | V3" |

SHUTTER MOVEMENT SPEED RELATIONS IS AS FOLLOWS:

V1 > V2, V3 > V2

V1' > V2', V3' > V2'

V1" > V2", V3" > V2"

V1 ≥ V1' ≥ V1"

V2 > V2' > V2"

V3 ≥ V3' ≥ V3"

| | ~ T1 | T1 ~ T2 | T2 ~ |
|---|---|---|---|
| ~ X | V1 | V1' | V1" |
| X ~ Y | V2 | V2' | V2" |
| Y~CLOSED | V3 | V3' | V3" |

SHUTTER MOVEMENT SPEED RELATIONS IS AS FOLLOWS:

V1 > V2, V3 > V2

V1' > V2', V3' > V2'

V1" > V2", V3" > V2"

V1 ≥ V1' ≥ V1"

V2 > V2' > V2"

V3 ≥ V3' ≥ V3"

IMAGE HEATING APPARATUS

BACKGROUND OF THE INVENTION

Field of the Invention

The present invention relates to an image heating apparatus which heats an image on a recording material and is utilized in an image forming apparatus which adopts an electrophotographic system, an electrostatic recording system or the like, such as copying machines, printers and facsimiles.

Conventionally, a heat roller method has been widely employed for an image heating apparatus of an image forming apparatus. In recent years, an image heating apparatus of a film heating method has been put into practical use because of its quick starting and energy saving characteristics.

With the image heating apparatuses of the heat roller method and the film heating method, there is a problem that the temperature at a non-sheet passing area rises when recording materials with a width narrower (hereinafter, called small size sheets) than recording materials of the maximum sheet passing width (hereinafter, called maximum size sheets) are continuously passing.

A method to enlarge sheet intervals when the small size sheets are continuously passing, which is the so-called through-put-down control, has been known as a countermeasure against the temperature rise at a non-sheet passing area. With this method, the thermal gradient becomes gentle by transferring the heat which is generated at the non-sheet passing area during the sheet-passing to a sheet-passing area and a fixing end portion. Further, a method to cool the area of non-sheet passing temperature rise by utilizing a fan has been known.

However, the countermeasure to enlarge the sheet intervals causes a problem of decreased productivity. This problem becomes notable and results in the decrease of the salability with a fixing device which utilizes a heating member and a pressing member of small heat capacity for energy saving.

Further, with the method in Patent Document 1, there is a problem in that various sheet sizes cannot be handled.

Further, with the apparatus in which the on-off state of a cooling fan is controlled by a temperature detecting portion of the non-sheet passing area while the cooling width can be changed corresponding to the recording material width as in JP 60-136779 and JP 2002-287564 or with the method of cooling the area of the non-sheet passing temperature rise by utilizing a blowing member, the following problem occurs. Since a peak of the temperature distribution exists within the non-sheet passing area, unevenness in temperature remains in the longitudinal direction when the non-sheet passing area is cooled evenly. Accordingly, when a large-size recording material arrives at the fixing portion in the next job, unevenness in gloss shows up on the image.

Furthermore, the method in JP 2007-79033 takes time for heat discharge. Therefore, there occurs a problem in that a certain amount of time (down time) is required before the next image heating process is started.

Furthermore, the method in Patent Document 3 takes time for heat discharge. Therefore, there occurs a problem in that a certain amount of time (down time) is required before the next image heating process is started.

An object of the present invention is to provide an image heating apparatus with which the unevenness in gloss is decreased and the time from the completion of an image heating process until the start of the next image heating process is shortened.

Another object of the present invention is to provide an image heating apparatus as described below.

SUMMARY OF THE INVENTION

An image heating apparatus of the present invention includes a heating rotor which heats a toner image while nipping and conveying a recording material on which the toner image is borne, a fan which cools the heating rotor, a blowing port which is arranged facing the heating rotor and through which blowing air passes from the fan toward the heating rotor, a shutter which is movable in the longitudinal direction of the heating rotor so as to change an opening area of the blowing port, and a control unit which moves the shutter in the longitudinal direction while rotating the fan after heating operation of the heating rotor to the toner image is completed.

Further features of the present invention will become apparent from the following description of exemplary embodiments with reference to the attached drawings.

DESCRIPTION OF THE EMBODIMENTS

First Embodiment

A first embodiment of the present invention will be described with reference to the drawings. Here, the following embodiment is an example of the exemplary embodiments of the present invention. The present invention is not limited to the structures described in the embodiment. Namely, each structure described in the embodiment can be replaced by a conventionally known structure within the scope of the present invention.

(Image Forming Portion)

Figure 1:
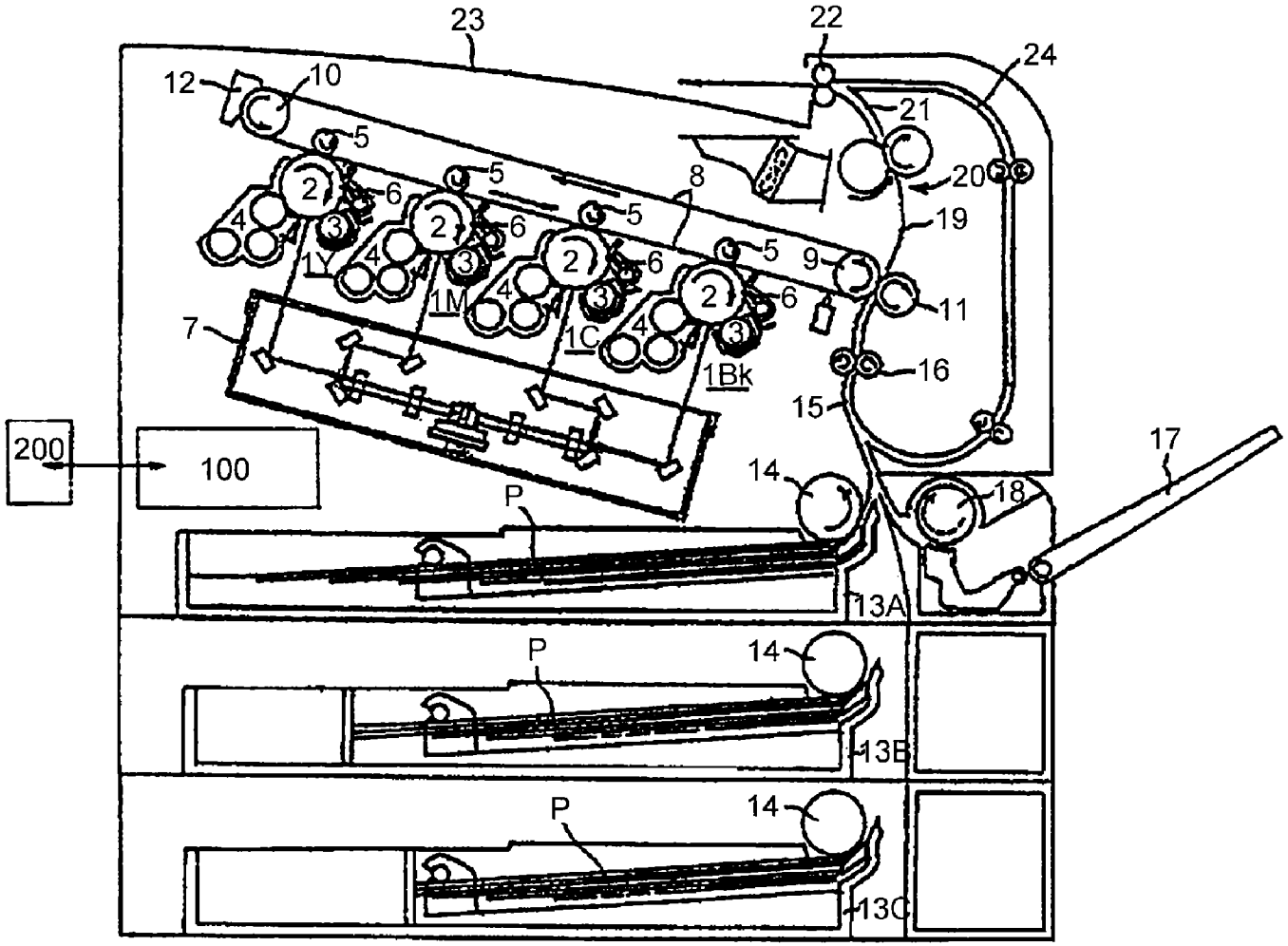
FIG. 1 is a vertical sectional view which schematically illustrates the general structure of an image forming apparatus.

First, an image forming portion will be briefly described. FIG. 1 is a vertical sectional view which schematically illustrates the general structure of an image forming apparatus.

A printer is capable of forming an image in full color on a recording material and outputting the recording material after performing an operation to form an image in accordance with input image information from an external host device 200 which is communicably connected to a control circuit portion (control portion) 100 having a CPU. When the control circuit portion 100 receives a print start signal from the external host device 200, the image forming operation is started.

The external host device 200 is a computer, an image reader or the like. The control circuit portion 100 exchanges signals with the external host device 200. The control circuit portion 100 also exchanges signals with various image forming devices and performs the sequential control of the image forming.

The image forming apparatus of the present embodiment has a belt 8. The belt 8 is a flexible intermediate transfer belt being shaped without an end and stretched between a secondary transfer counter roller 9 and a tension roller 10. When the secondary transfer counter roller 9 is driven, the belt 8 is driven to rotate at a predetermined speed in the counterclockwise direction as indicated by a narrow. Further, a secondary transfer roller 11 is arranged being pressed to the secondary transfer counter roller 9 via the belt 8. The pressed portion between the belt 8 and the secondary transfer roller 11 is a secondary transfer portion.

Four image forming portions 1 (1Y, 1M, 1C and 1Bk) are arranged at the upstream side of the recording material conveying direction of the secondary transfer portion. The image forming portions 1 are arranged in a line at predetermined intervals along the belt movement direction at the lower side of the belt 8.

Each of the image forming portions is an electrophotographic process mechanism of a laser exposure system and has a drum-shaped electrophotographic sensitizing member (drum 2) as an image bearing member which is driven to rotate at a predetermined speed in the clockwise direction as indicated by an arrow.

A primary charger 3, a developing device 4, a transfer roller 5 serving as a transfer member, and a drum cleaning device 6 are arranged around each of the drums 2. Each of the transfer rollers 5 is arranged inside the belt 8 and pressed to the corresponding drum 2 via a descending part of the belt 8. The pressed portions between each of the drums 2 and the belt 8 are the primary transfer portions.

Further, a laser exposure device 7 by which the drum 2 of each of the image forming portions is exposed is arranged at the image forming apparatus. The laser exposure device 7 includes a laser irradiating portion which performs irradiation corresponding to a time sequential electro-digital pixel signal of given image information, a polygon mirror and a reflection mirror.

The control circuit portion 100 drives each of the image forming portions to form an image based on a color separation image signal which is input from the external host device 200. Accordingly, color toner images of yellow, magenta, cyan and black are formed at the four image forming portions 1 (1Y, 1M, 1C and 1Bk). The toner images are formed on a surface of the rotating drum 2 at predetermined control timing.

The belt 8 is driven to rotate at a speed corresponding to the rotation speed of the drums 2. Here, the above-mentioned toner images which are formed on the surfaces of the drums 2 of the image forming portions are sequentially superimposed and transferred to the belt 8 respectively at the primary transfer portion in the same direction as the rotation direction of the drums 2. In this manner, a full-color toner image which is unfixed is formed on the belt 8 by superposing the above-mentioned four toner images.

On the other hand, a feeding roller 14 of a selected sheet cassette portion 13 is driven and a recording material P is fed at predetermined feeding timing. The sheet cassette portion 13 includes multi-layered sheet cassette portions 13A, 13B and 13C in which recording materials of variety of width sizes are accommodated respectively. With this structure, one sheet of the recording materials P which are accommodated in the sheet cassette at the selected layer is separated and fed, and then, conveyed to a registration roller 16 via a vertical conveying path 15.

When manual feeding is selected instead of the feeding from the sheet cassette portion 13, a feeding roller 18 is driven. With this structure, one sheet of the recording materials which are loaded on a manual feeding tray (multi-purpose tray) 17 is separated and fed, and then, conveyed to the registration roller 16 via the vertical conveying path 15.

The registration roller 16 timely conveys the recording material P so that the top end of the recording material P arrives at the secondary transfer portion to match the timing when the top end of the above-mentioned full-color toner image on the rotating belt 8 arrives at the secondary transfer portion. Accordingly, the full-color toner image on the belt 8 is thoroughly transferred secondarily on the surface of the recording material P at the secondary transfer portion.

The recording material leaving the secondary transfer portion is separated from the surface of the belt 8 and introduced to a fixing device (fixing implement) 20 while being guided by a vertical guide 19. The above-mentioned toner image in plural colors is melted and mixed by the fixing device 20 so as to be fixed on the surface of the recording material as a permanently fixed image. The recording material leaving the fixing device 20 is discharged onto a discharge tray 23 via a conveying path 21 by a discharge roller 22 as a full-color image formed sheet.

After the recording material is separated at the secondary transfer portion, the surface of the belt 8 is cleaned by a belt cleaning device 12 so as to remove remaining deposit such as remaining toner after the secondary transfer. Then, the belt 8 is repeatedly used for image forming.

In the case where a monochrome print mode is selected, the image forming operation of only the image forming portion 1Bk which forms a black toner image is controlled. In the case where a two-sided print mode is selected, the first face printed recording material is to be discharged onto the discharge tray 23 by the discharge roller 22 and the rotation of the discharge roller 22 is reversed just before the rear end of the recording material passes through the discharge roller 22. Accordingly, the recording material is introduced to a re-conveying path 24 by being switched back. Then, the recording material is conveyed to the registration roller 16 once more in the state that faces are reversed. Subsequent to the above, as in the first face printing, the recording material is conveyed to the secondary transfer portion and the fixing device 20 and is discharged onto the discharge tray 23 as a two-side image formed sheet.

(Fixing Device 20)

In the following description, the longitudinal direction of the fixing device and structuring members thereof is the direction parallel to the direction perpendicular to the recording material conveying direction on a recording material conveying passage surface. Regarding the fixing device, the front face is the face at the recording material introducing side. The left and right are the left side and right side of the device viewed from the front face. The width of the recording material is the dimension of the recording material in the direction perpendicular to the recording material conveying direction on the recording material surface.

Figure 2:
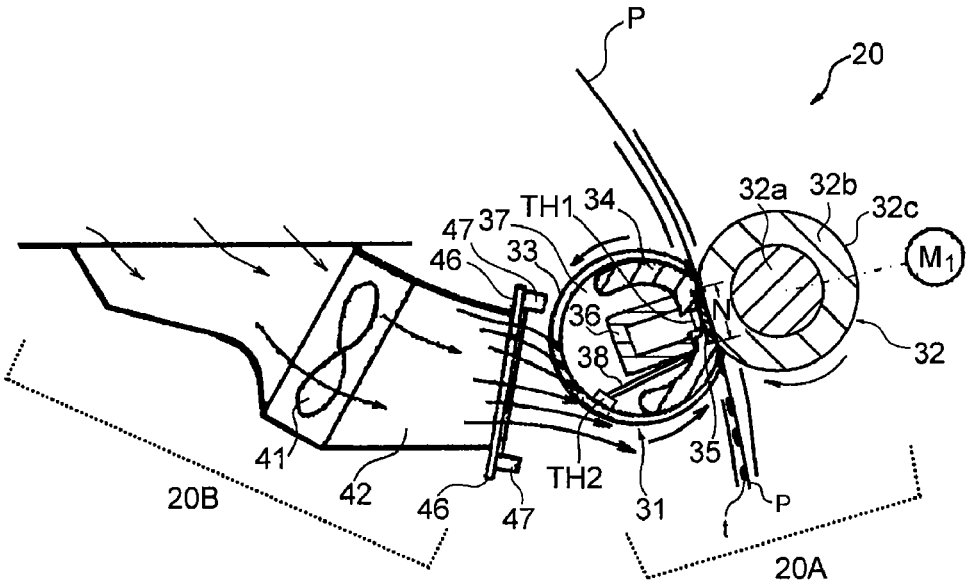
FIG. 2 is a side sectional view which schematically illustrates the general structure of a fixing device.
Figure 3:
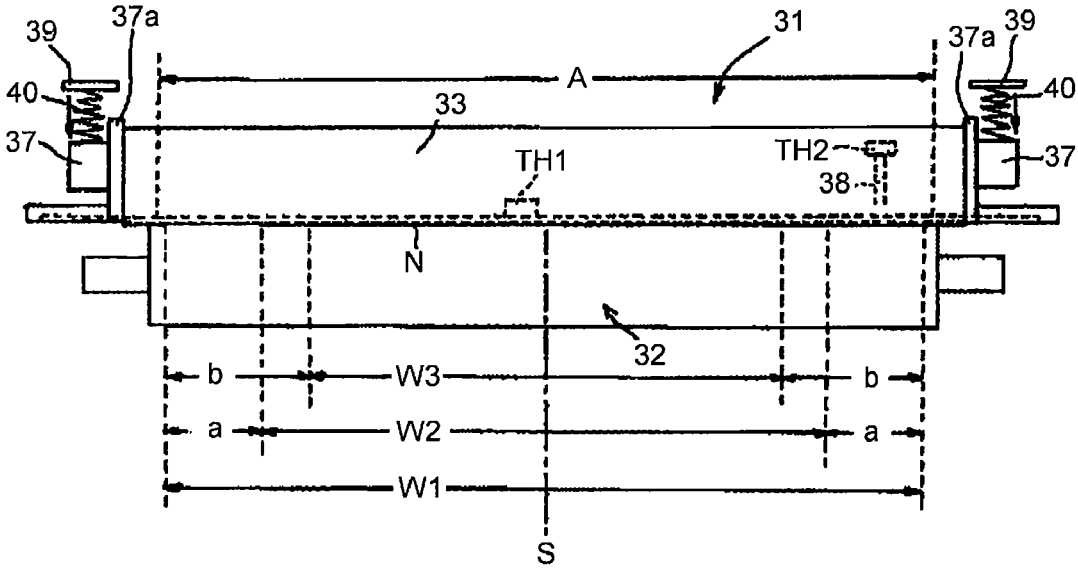
FIG. 3 is a front view which schematically illustrates a fixing mechanism portion.
Figure 4:
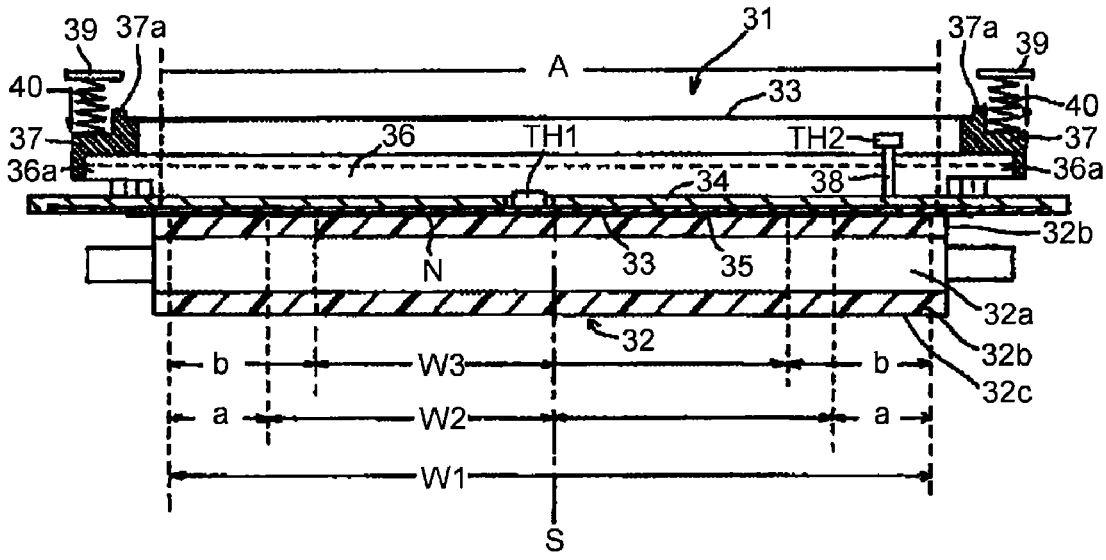
FIG. 4 is a vertical sectional front view which schematically illustrates the fixing mechanism portion.
Figure 5:
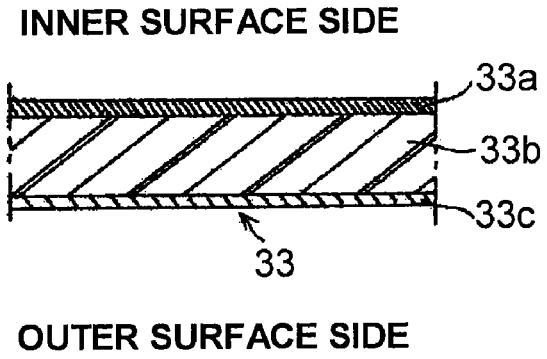
FIG. 5 is a schematic view of the layer structure of a fixing film.
Figure 6:
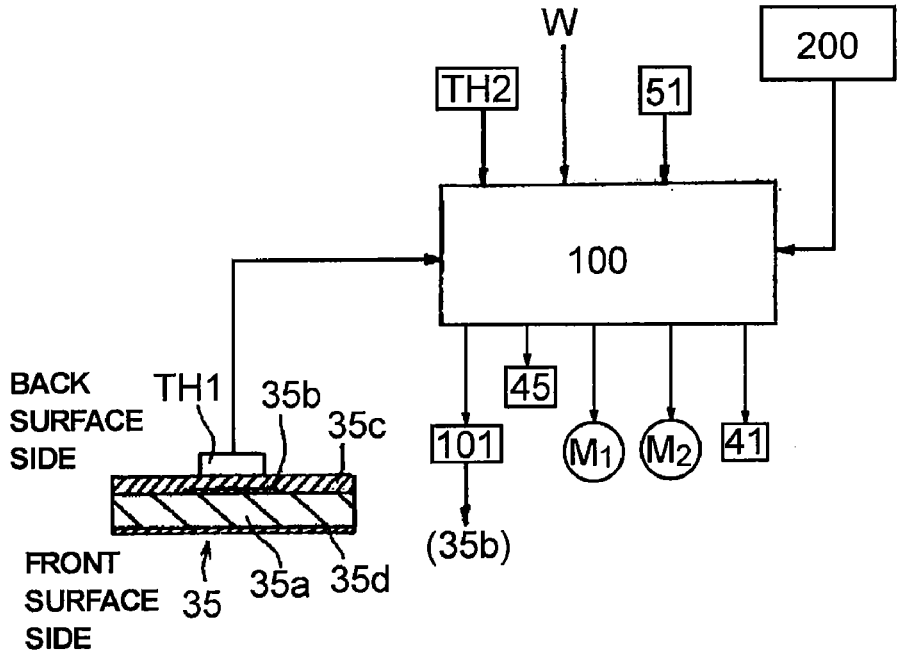
FIG. 6 is a schematic side sectional view and a control system diagram of a heater.

FIG. 2 is a side sectional view which schematically illustrates the general structure of the fixing device as a heating apparatus of the present embodiment. The fixing device 20 is roughly divided into a fixing mechanism portion 20A of a film (belt) heating method and a blow-cooling mechanism portion 20B. FIG. 3 is a front view which schematically illustrates the fixing mechanism portion. FIG. 4 is a vertical sectional front view which schematically illustrates the fixing mechanism portion. FIG. 5 is a schematic view of the layer structure of a fixing film. FIG. 6 is a schematic side sectional view and a control system diagram of a heater.

(Fixing Mechanism Portion 20A)

First, the outline of the fixing mechanism portion 20A will be described by utilizing FIGS. 2 to 4. Basically, the fixing mechanism portion 20A is an on-demand fixing device of a film heating method or a pressure rotor driving method (tensionless type) which is disclosed in Japanese Patent Application Laid-Open Nos. 4-44075 to 4-44083 and 4-204980 to 4-204984.

The fixing device 20 includes a film assembly 31 as a heating member (heating rotor) and an elastic pressure roller 32 as a pressing member. The film assembly 31 and the elastic pressure roller 32 form a fixing nip portion N with pressing contact therebetween.

The film assembly 31 includes the following. A fixing film (hereinafter, abbreviated as the film) 33 is flexible and is shaped cylindrical as the image heating member. A film guide member (hereinafter, abbreviated as the guide member) 34 which is heat-resistant and rigid and is approximately shaped semicircular like a gutter in the side sectional view. A ceramic heater (hereinafter, abbreviated as the heater) 35 is firmly arranged at the outer surface of the guide member 34 while being fitted into a groove portion which is formed at the guide member along the longitudinal direction. The film 33 is loosely fitted externally to the guide member 34 to which the heater 35 is attached. A stiff pressure stay (hereinafter, abbreviated as the stay) 36 of which side section is U-shaped with right angles is arranged inside the guide member 34. End holders 37 are respectively press-fitted to externally projecting arm portions 36*a* at the bilateral ends of the stay 36. A flange portion 37*a* is integrally formed at the end holder 37.

As illustrated in FIG. 4, the hardness of the elastic pressure roller 32 is decreased by forming an elastic layer 32*b* made of silicone rubber etc. onto a cored bar 32*a*. In order to improve the surface quality, it is also possible to further form a fluororesin layer 32*c* such as PTFE, PFA and FEP on the outer surface of the roller 32. The elastic pressure roller 32 is arranged as a pressure rotating member in the state that both ends of the cored bar 32*a* are rotatably supported by bearing members between bilateral side boards of an apparatus chassis (not illustrated in the drawings).

The film assembly 31 is arranged in parallel to the elastic pressure roller 32 while the heater 35 side is facing thereto. The film assembly 31 has pressure springs 40 which are arranged as being compressed respectively between the bilateral end holders 37 and bilateral fixed spring receiving members 39. Accordingly, the stay 36, the guide member 34 and the heater 35 are urged to be pressed toward the elastic pressure roller 32. The fixing nip portion N is formed with a predetermined width in the recording material conveying direction between the film 33 and the elastic pressure roller 32 by setting the pressing urge force at a predetermined value so that the heater 35 is pressure-contacted to the elastic pressure roller 32 against the elasticity of the elastic layer 32*b* while sandwiching the film 33.

As illustrated in FIG. 5, the film 33 of the present embodiment has a three-layer combined structure of a base layer 33*a*, an elastic layer 33*b* and a toner parting layer 33*c* in the order from the inner face side to the outer face side. In order to decrease the heat capacity and improve the quick start performance, a heat-resistant film of which thickness is not more than 100 μm, preferably not less than 20 μm and not more than 50 μm, can be used for the base layer 33*a*. For example, a film which is made of polyimide, polyimide-amide, PEEK, PES, PPS, PTFE, PFA, FEP or the like or a metal sleeve which is made of SUS, Ni or the like can be used. A cylindrical SUS sleeve of which diameter is 30 mm is utilized in the present embodiment. Silicone rubber of which rubber hardness is 10 degrees (JIS-A), of which heat conductivity is 1.0 W/m·K, and of which thickness is 300 μm is utilized for the elastic layer 33*b*. A PFA tube layer of which thickness is 30 μm is utilized for the toner parting layer 33*c*.

The heater 35 of the present embodiment is a back surface heating type of which heater substrate utilizes aluminum nitride etc. and is a horizontally long wire heat generator having small heat capacity with the longitudinal direction being orthogonal to the movement direction of the film 33 and the recording material P.

FIG. 6 is a schematic side sectional view and a control system diagram of the heater 35. The heater 35 has the heater substrate 35*a* which is made of aluminum nitride etc. An energized heat generating layer 35*b* is arranged along the longitudinal direction at the back surface side (the surface side opposite to the surface facing the fixing film) of the heater substrate 35*a*. The energized heat generating layer 35*b* is formed by coating electro-resistance material such as Ag/Pd (argentum/palladium), for example, with the thickness of about 10 μm and the width of 1 to 5 mm by screen printing. Further, a protecting layer 35*c* made of glass or fluororesin is arranged thereon. In the present embodiment, a slide member (lubrication member) 35*d* is arranged at the front surface side (the surface side facing the film) of the heater substrate 35*a*.

The heater 35 is firmly fitted into a groove portion which is formed approximately at the middle part of the outer surface of the guide member 34 along the longitudinal direction of the guide in the state that the heater substrate front surface side to which the slide member 35*d* is arranged is exposed. The slide member 35*d* surface of the heater 35 and the inner surface of the film 33 are contacted while mutually sliding at the fixing nip portion N. Then, the film 33 which is the rotating image heating member is heated by the heater 35.

When electricity is supplied between both ends in the longitudinal direction of the energized heat generating layer 35*b* of the heater 35, heat is generated at the energized heat generating layer 35*b* so that the temperature of the heater 35 rapidly rises at full range of effective heat generating width A in the heater longitudinal direction. The heater temperature is detected by a sensor (center temperature detecting member) TH1 such as a thermistor which is arranged being contacted to the outer surface of the protecting layer 35*c*. The output (the signal value of the temperature) of the sensor TH1 is input to the control circuit portion 100 via an A/D converter.

The control circuit portion 100 controls the power from a power source (power supply portion, heater drive circuit portion) 101 to the energized heat generating layer 35*b* so as to maintain the heater temperature at a predetermined temperature based on the input detected temperature information. Namely, the temperature of the film 33 which is the image heating member heated by the heater 35 is controlled to a predetermined fixing temperature in accordance with the output of the sensor TH1.

With the above-mentioned structure, the fixing device 20 is operated as follows.

As illustrated in FIG. 2, the elastic pressure roller 32 is driven by a motor (driving portion) $M_1$ to be rotated in the clockwise direction as indicated by an arrow. Rotation force is applied to the film 33 by friction force of the elastic pressure roller 32 and the outer surface of the film 33 at the fixing nip portion N caused by the rotation of the elastic pressure roller 32. Accordingly, the film 33 is rotated in the counterclockwise direction as indicated by an arrow around the outside of the guide member 34 while the inner surface of the film 33 is sliding in tight contact with the heater 35 at the fixing nip portion N (the pressure roller dive method).

The film 33 is rotated at a circumferential speed approximately corresponding to a circumferential speed of the rotation of the elastic pressure roller 32. In the case where the rotating film 33 is shifted to the left or right along the longitudinal direction of the guide member 34, the bilateral flange portions 37*a* function to receive the belt end portion of the shifting side so that the shifting is regulated. In order to decrease the friction force of the mutual sliding of the heater 35 and the inner surface of the film 33 at the fixing nip portion N, the slide member 35*d* is arranged at the heater surface at the fixing nip portion N so that lubricant such as heat-resistance grease is to be existed against the inner surface of the film 33.

Then, based on a print start signal, the rotation of the elastic pressure roller 32 is started and the heat-up of the heater 35 is started. In the state that the circumferential speed of the rotation of the film 33 is stabilized and the temperature of the heater 35 reaches a predetermined value, the recording material P to which a toner image t is borne is introduced to the fixing nip portion N as the toner image bearing surface side faces the film 33 side. The recording material P passes through the fixing nip portion N along with the film 33 in tight contact with the heater 35 via the film 33 at the fixing nip portion N.

During the process of the passing, heat is applied to the recording material P from the film 33 which is heated by the heater 35 and the toner image t is heated and fixed on the recording material P surface. The recording material P which passes through the fixing nip portion N is separated from the film 33 to be discharged and conveyed.

In the present embodiment, the conveyance of the recording material P is performed based on the recording material center which is so-called center-based conveyance. Namely, all the recording materials of any width which are capable of passing through the apparatus pass in the state that the center of the recording material in the width direction is aligned with the center of the film 33 in the longitudinal direction. In FIGS. 3 and 4, the center baseline for the passing of the recording material (phantom line) is indicated by S.

In FIG. 3 and FIG. 4, the maximum sheet passing width of the recording material which is capable of passing through the apparatus is indicated by W1. In the present embodiment, the maximum sheet passing width W1 is the width of longitudinal A3 size which is 297 mm (in A3 longitudinal feeding). The effective heat generating width A in the heater longitudinal direction is configured to be slightly larger than the maximum sheet passing width W1.

The minimum sheet passing width of the recording material which is capable of passing through the apparatus is indicated by W3. In the present embodiment, the minimum sheet passing width W3 is the width of longitudinal A4 size which is 210 mm (in A4 longitudinal feeding). The middle sheet passing width of the recording material of which width is between the maximum sheet passing width W1 and the minimum sheet passing width W3 is indicated by W2. In the present embodiment, the middle sheet passing width W2 is the width of LGL size which is 216 mm. However, the middle sheet passing width can be the width of LTR size which is 279 mm (not illustrated in the drawings). Hereinafter, the recording material of which width corresponds to the maximum sheet passing width W1 is called the maximum size recording material and the recording material of which width is smaller than the maximum sheet passing width W1 is called the small size recording material.

In FIG. 3 and FIG. 4, the width difference area ((W1−W2)/2) between the maximum sheet passing width W1 and the middle sheet passing width W2 is indicated by a. Further, the width difference area between the maximum sheet passing width W1 and the minimum sheet passing width W3 is indicated by b. Namely, the width difference areas a, b are the non-sheet passing areas occurring when the recording materials of LGL and A4R which are the small size recording materials respectively pass. In the present embodiment, since the recording material passing is performed as center-based, the non-sheet passing areas a, b respectively occur at both ends of the middle sheet passing width W2 or at both ends of the minimum sheet passing width W3. The width of the non-sheet passing area varies in accordance with the width of the small size recording material which is used for the passing.

The sensor TH1 is arranged to detect the heater temperature (the sheet passing area temperature) in the area corresponding to the minimum sheet passing width W3. Further a sensor (end area temperature detecting member) TH2 such as a thermistor detects the temperature at the non-sheet passing area. These outputs (signals of the temperature) are input to the control circuit portion 100 via the A/D converter.

In the present embodiment, the sensor TH2 is arranged being elastically contacted to the inner surface of the base layer of the film part corresponding to the non-sheet passing area a. Specifically, the sensor TH2 is arranged at the free end of an elastic support member 38 of a plate spring shape of which base part is fixed to the guide member 34. Then, the sensor TH2 is elastically contacted to the inner surface of the base layer 33*a* of the film 33 with the elasticity of the elastic support member 38 so that the temperature of the film part corresponding to the non-sheet passing area a is detected.

Here, the sensor TH1 can be arranged to be elastically contacted to the inner surface of the base layer of the film part corresponding to the minimum sheet passing width W3. In contrast, the sensor TH2 can be arranged so as to detect the heater temperature corresponding to the non-sheet passing area a.

(Blow-Cooling Mechanism Portion 20B)

Figure 7:
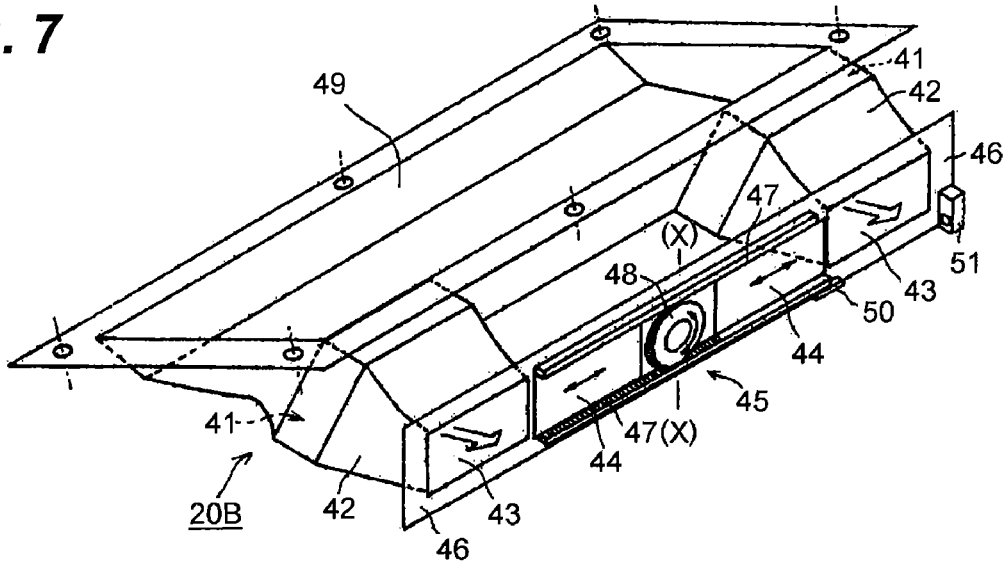
FIG. 7 is a schematic perspective view of a blow-cooling mechanism portion.
Figure 8:
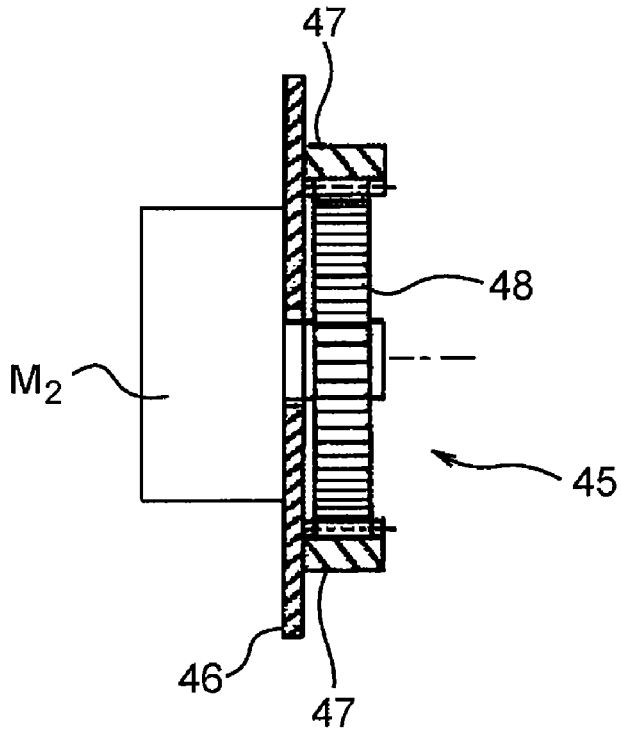
FIG. 8 is an enlarged sectional view along the X-X line in FIG. 7.
Figure 9:
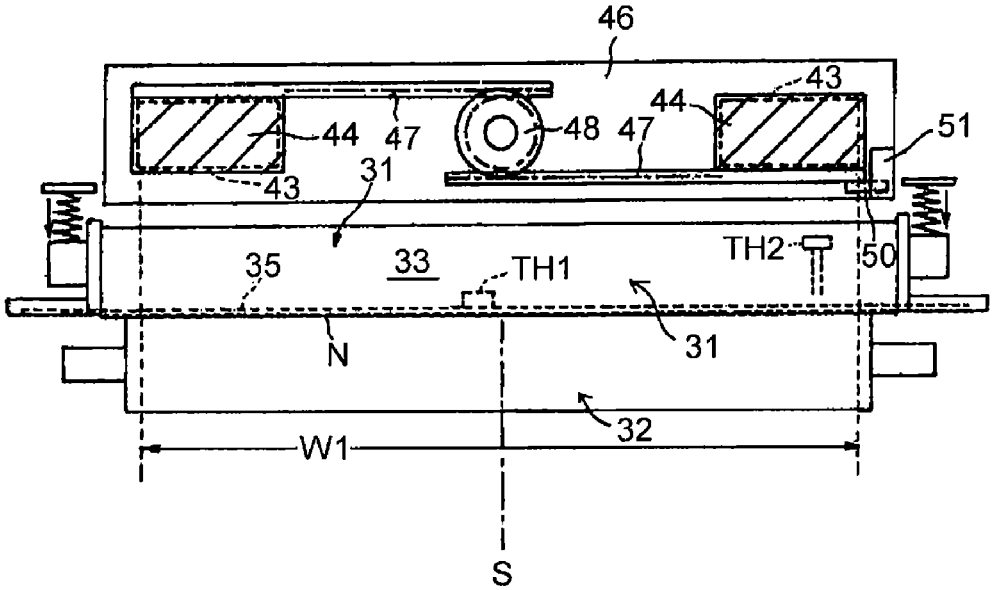
FIG. 9 is a view which illustrates a state that a blowing port is fully closed by fully closing a shutter.
Figure 10:
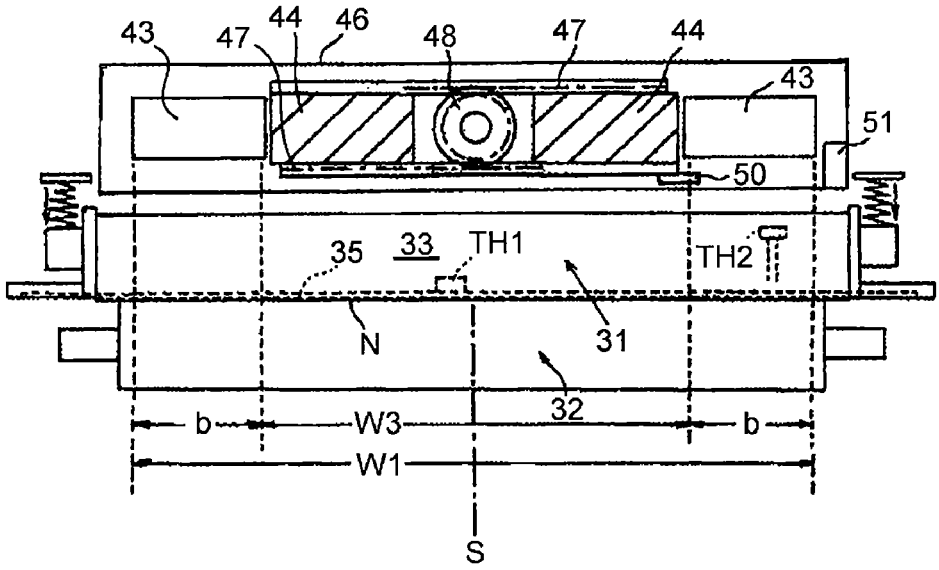
FIG. 10 is a view which illustrates a state that the blowing port is fully opened by fully opening the shutter.
Figure 11:
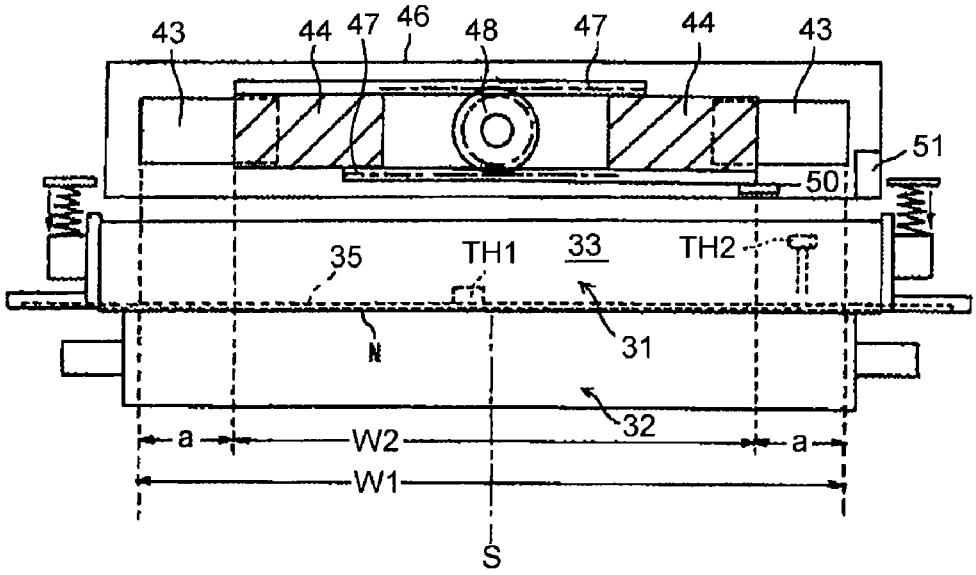
FIG. 11 is a view which illustrates a state that the shutter is opened only at areas corresponding to non-sheet passing areas.

The blow-cooling mechanism portion 20B is a cooling portion for blow-cooling of the temperature rise at the non-sheet passing area of the film 33 generated when the small size recording materials are continuously passed (the small size job). FIG. 7 is a schematic perspective view of the blow-cooling mechanism portion 20B. FIG. 8 is an enlarged sectional view along the X-X line in FIG. 7. FIG. 9 is a view which illustrates a state that a blowing port 43 is fully closed by fully closing a shutter. FIG. 10 is a view which illustrates a state that the blowing port 43 is fully opened by fully opening the shutter. FIG. 11 is a view which illustrates a state that the shutter is opened only at areas corresponding to the non-sheet passing areas.

The blow-cooling mechanism portion 20B in the present embodiment will be described with reference to FIGS. 2, 7 and 8. The blow-cooling mechanism portion 20B has a cooling fan (hereinafter, abbreviated as the fan) 41 as a blowing member. Further, the blow-cooling mechanism portion 20B also includes a blowing duct 42 which introduces air flow generated by the fan 41 and the blowing port (duct opening port) 43 which is arranged to the blowing duct 42 at apart facing the fixing mechanism portion 20A. Further, the blow-cooling mechanism portion 20B also includes a shutter (masking plate) 44 which opens and closes the blowing port 43 and adjusts the opening width to the width suitable for the width of the passing recording material, and a shutter drive device (opening width adjusting portion) 45 which drives the shutter 44.

The fan 41, the blowing duct 42, the blowing port 43 and the shutter 44 are arranged being bilaterally symmetric in the longitudinal direction of the film 33. An intake channel portion 49 is arranged at the intake side of the fan 41. A centrifugal fan such as a sirocco fan can be utilized for the fan 41.

The bilateral shutters 44 are supported being free to slide in the horizontal direction along a plate surface of a support plate 46 which extends in the horizontal direction and to which the blowing ports 43 are formed. The bilateral shutters 44 are linked with a rack gear 47 and a pinion gear 48. The pinion gear 48 is driven in forward rotation or reverse rotation by a motor (pulse motor) $M_2$. Accordingly, the bilateral shutters 44 are synchronized to symmetrically open and close the corresponding blowing ports 43 respectively. The shutter drive device 45 is structured by the support plate 46, the rack gear 47, the pinion gear 48 and the motor $M_2$.

The bilateral blowing ports 43 are arranged from the position slightly center side of the non-sheet passing area b which occurs when the minimum width recording material passes to the position of the maximum sheet passing width W1. The bilateral shutters 44 are arranged in the direction to close the blowing ports 43 by a predetermined amount from the longitudinal center toward the outer side of the support plate 46.

As illustrated in FIG. 6, width information W of the passing recording material based on information of user's input of the recording material size or information from an automatic detecting mechanism (not illustrated in the drawings) of the recording material width of the sheet cassette portion 13 and the manual feeding tray 17 is input to the control circuit portion 100. Then, the control circuit portion 100 controls the shutter drive device 45 based on the width information W. Namely, by rotating the pinion gear 48 with the drive of the motor $M_2$ and moving the shutter 44 with the rack gear 47, the blowing port 43 is opened by a predetermined amount.

Specifically, the control circuit portion 100 controls the shutter drive device 45 as follows. When the width information W of the recording material indicates the large-size recording material of A3 size width, the control circuit portion 100 controls the shutter drive device 45 to move the shutter 44 to fully close the blowing port 43, as illustrated in FIG. 9 (the fully closed position). When the width information W of the recording material indicates the small size recording material of A4R size width, the control circuit portion 100 moves the shutter 44 so as to fully open the blowing port 43, as illustrated in FIG. 10 (the fully opened position). Further, when the width information W of the recording material indicates the small size recording material of B4 size width, the control circuit portion 100 moves the shutter 44 so as to open the blowing port 43 only at the area corresponding to the non-sheet passing area a, as illustrated in FIG. 11.

Here, when the small size recording material of LTR-R, EXE, K8, LTR or the like is passing, the control circuit portion 100 moves the shutter 44 so as to open the blowing port 43 corresponding to the non-sheet passing area which occurs respectively for each case. Namely, the shutter 44 is capable of adjusting the opening width of the blowing port 43 in accordance with the width of the recording material. Here, the recording materials of the minimum size, the maximum size and other sizes are specific sheets which are guaranteed by the image forming apparatus, not sheets of undefined sizes which are originally prepared by a user.

Position information of the shutter 44 is determined by detecting a flag 50 arranged at a predetermined position of the shutter 44 by a sensor 51 arranged on the support plate 46. Specifically, as illustrated in FIG. 9, a home position is determined at the shutter position when the blowing port 43 is fully closed and opening amount is determined by the rotation amount of the motor $M_2$.

It is also possible to dispose an opening width detecting sensor which directly detects the current position of the shutter 44. In this case, the control circuit portion 100 obtains feedback of the shutter position information from the sensor, and the shutter 44 is controlled to move to an appropriate opening width position in accordance with the width of the passing recording material. By detecting the edge position of the shutter 44, the stop position of the shutter 44 is precisely determined in accordance with the width of the small size recording material. Therefore, it is possible to perform blowing with cooling air only toward the non-sheet passing area (outside the recording material conveyance area) of all the small size recording materials.

(Operation at the Non-Sheet Passing Temperature Rise)

Figure 12:
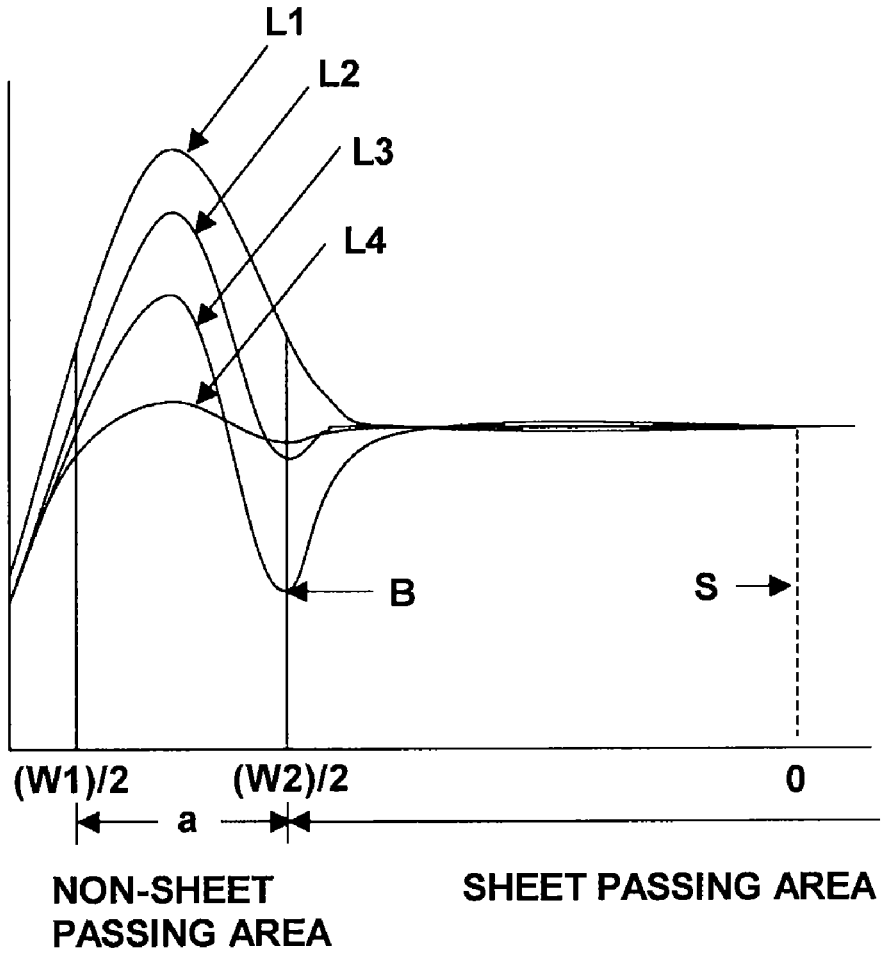
FIG. 12 is a graph to describe temperature distribution of Comparative Example.

The non-sheet passing temperature rise in the case that the small size recording materials (here, LGL size sheets) are continuously passing (the small size job) will be described based on FIGS. 11 and 12. FIG. 12 is a graph to describe temperature distribution of Comparative Example.

When the heater 35 is controlled based on the detected temperature from the sensor TH1 so as to supply sufficient amount of heat to the recording material of LGL size which passes the middle sheet passing width W2, the heat is not discharged from the non-sheet passing area a. Therefore, the temperature of the film assembly 31 and the elastic pressure roller 32 at the area corresponding to the non-sheet passing area a is increased compared with the temperature at the sheet passing area (the recording material conveyance area). The temperature distribution of the fixing nip portion N in the longitudinal direction is illustrated by the solid line L1 in FIG. 12. This solid line L1 indicates the non-sheet passing temperature rise.

The peak temperature at the non-sheet passing area of the solid line L1 reaches the breakage temperature. Further, hot offset occurs at the end of the middle sheet passing width W2 because the heat at the non-sheet passing area is transmitted to the sheet passing area.

Conventionally, in order to solve the above-mentioned problems without decreasing productivity, the following control has been performed.

First, the control circuit portion 100 drives the fan 41 of the blow-cooling mechanism portion 20B in accordance with the detected temperature by the sensor TH2. In synchronization with the timing of driving the fan 41, a shutter control signal based on the width information W of the recording material is transmitted to the shutter drive device 45 and the motor $M_2$ is driven so that the shutter 44 is moved to the position matching the middle sheet passing width W2. Namely, the blowing port facing the non-sheet passing area a is opened. Then, the cooling air which is generated by the fan 41 is blown to the non-sheet passing area of the fixing mechanism portion 20A. The temperature at the non-sheet passing area is decreased by receiving the cooling air. Therefore, fixed images can be obtained without decreasing the productivity to enlarge sheet intervals. The temperature distribution at the fixing nip portion N in the longitudinal direction is illustrated by a solid line L2 in FIG. 12.

Comparative Example 1

When the large-size recording material of A3 size width passes thereafter, the hot offset occurs. Therefore, the cooling (the blowing operation) is continuously performed after the job is completed. However, in this case, the following problem occurs. Although the temperature distribution of the non-sheet passing area has a peak after the sheet passing is completed, the cooling is evenly performed. Therefore, the temperature distribution in the longitudinal direction does not become even as illustrated by a solid line L3 in FIG. 12. Consequently, unevenness in gloss shows up due to the unevenness of the temperature. In particular, an area B in FIG. 12 of which temperature is low appears at the boundary area between the middle sheet passing width W2 and the non-sheet passing area a.

Comparative Example 2

Then, when heat is discharged by stopping the blow-cooling mechanism portion 20B after the image heating operation is completed so as to prevent the unevenness in gloss of the image, temperature distribution which is even in the longitudinal direction can be obtained as illustrated by a solid line L4 in FIG. 12. However, with this method, it takes 30 to 60 seconds until the temperature distribution becomes even in the longitudinal direction of the heating member.

In the present embodiment, in the case that the cooling operation is performed during the image heating operation, when the fixing operation is completed or the switching operation of the recording material width is performed, the cooling area is changed by moving the shutter and the blowing by the cooling fan is continued while continuing the operation of the heating member. In this manner, the cooling amount in the longitudinal direction is controlled. Next, examples of the present embodiment will be described.

Example 1

Figure 13:
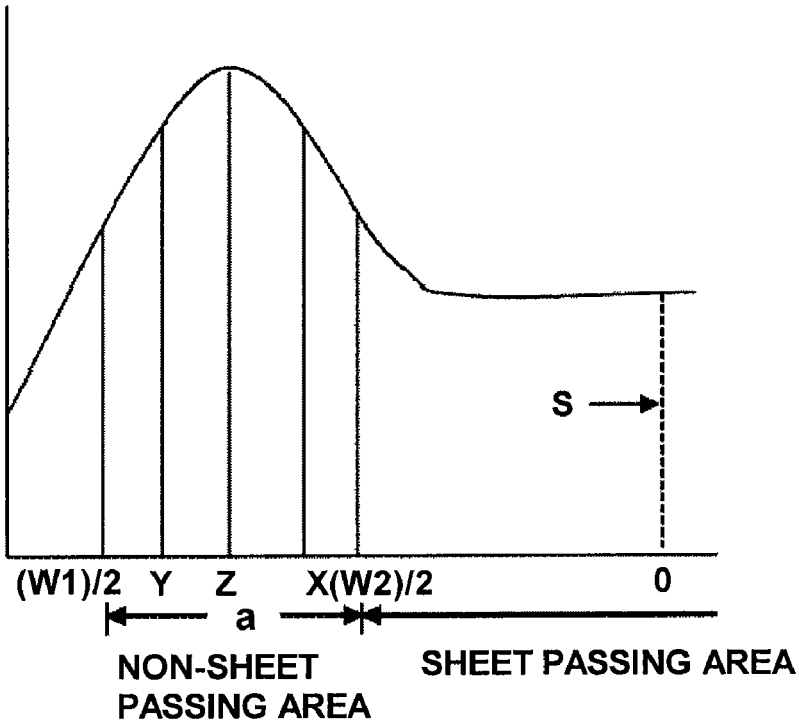
FIG. 13 is a graph which illustrates temperature distribution of a fixing nip portion in the longitudinal direction of Example 1.
Figure 14:
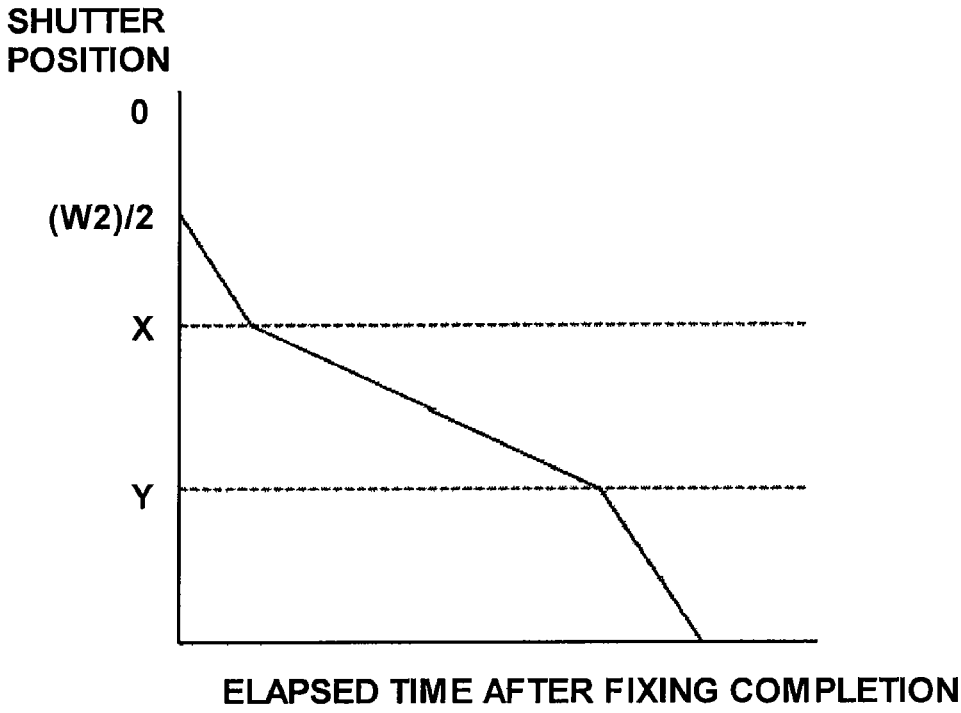
FIG. 14 is a graph which illustrates a movement condition of the shutter of Example 1.
Figures 15, 16:
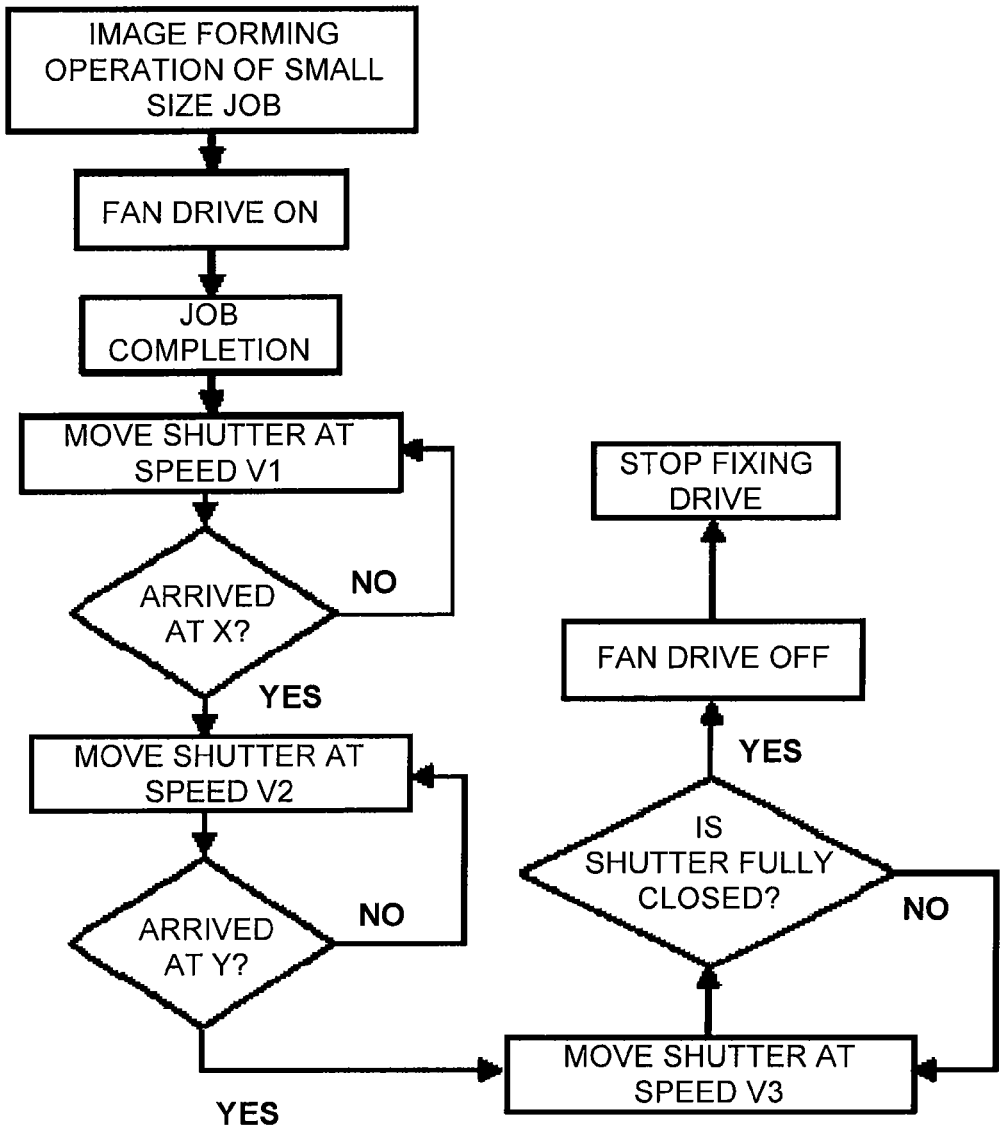
FIG. 15 is a table which expresses the relations between shutter position and shutter movement speed of Example 1.
FIG. 16 is a flowchart of the movement control etc. of the shutter of Example 1.

Example 1 will be described by utilizing the drawings. FIG. 13 is a graph which illustrates temperature distribution of the fixing nip portion in the longitudinal direction of Example 1. FIG. 14 is a graph which illustrates a movement condition of the shutter of Example 1. FIG. 15 is a table which expresses the relations between the shutter position and the shutter movement speed of Example 1. FIG. 16 is a flowchart of the movement control etc. of the shutter of Example 1.

In FIGS. 13 to 16, shutter operation changing positions X, Y are located to sandwich a temperature peak position within the non-sheet passing area. The temperature peak position (the position at which the sensor TH2 detects the highest temperature) of the non-sheet passing area is indicated by Z in FIG. 13. Here, it is preferable that the shutter operation changing position X be located at the middle between (W2)/2 and the temperature peak position Z and that the shutter operation changing position Y be located at the middle between the temperature peak position Z and (W1)/2.

As illustrated or indicated in FIGS. 14 to 16, the shutter is closed at the speed of V1 between (W2)/2 and the shutter operation changing position X. Accordingly, the boundary area between the sheet passing area (W2)/2 and the non-sheet passing area a can be prevented from being excessively cooled. Next, the shutter is closed at the speed V2, which is slower than the speed V1, between the shutter operation changing positions X, Y so as to sufficiently cool the temperature peak of the non-sheet passing area. Alternatively, it is also possible to stop the shutter at the shutter operation changing position X. In this case, the shutter is closed to the fully closed position at the speed V1 after a predetermined time passes. Next, the shutter is closed after the shutter operation changing position Y at the speed V3, which is faster than the speed V2, because the temperature is sufficiently lowered by heat discharge.

Here, depending on the width of the small size recording material, there is a case in which the shutter operation changing position X or Y is located within the sheet-passing area. Therefore, the shutter movement speed is changed in accordance with the sheet size, as indicated in FIG. 15. Namely, when the shutter operation changing positions X, Y are located within the non-sheet passing area, the shutter movement speed is changed twice. When only the shutter operation changing position X is located within the sheet passing area, the shutter movement speed is changed once. When both the shutter operation changing positions X, Y are located within the sheet passing area, the shutter movement speed is not changed.

As described above, in Example 1, the control circuit portion 100 controls the movement speed of the shutter 44 to be slowest at the position Z where the highest temperature is detected by the sensor TH2 in the non-sheet passing area. With this method, it takes only about 10 seconds until the temperature distribution in the longitudinal direction of the heating member becomes even. Accordingly, compared with the case in which heat discharge is performed while stopping the cooling after the image heating operation is completed, down time can be considerably reduced.

Example 2

Figures 17, 18:
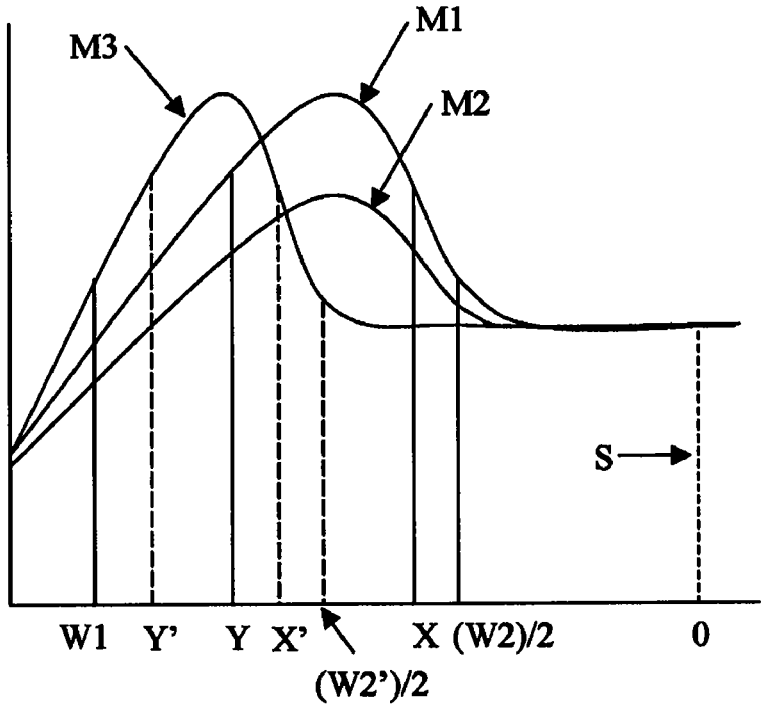
FIG. 17 is a graph which illustrates temperature distribution of the fixing nip portion in the longitudinal direction of Example 2.
FIG. 18 is a graph which illustrates a movement condition of the shutter of Example 2.
Figures 19, 20:
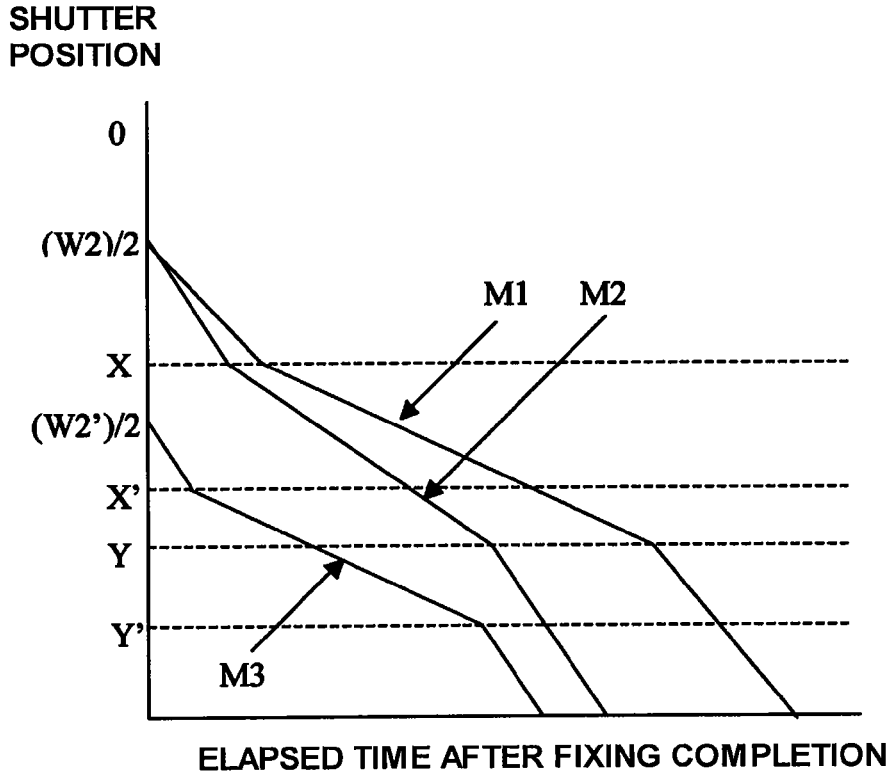
FIG. 19 is a table which expresses the relations between the shutter position and the shutter movement speed of Example 2.
FIG. 20 is a table which expresses the relations between the shutter position and the shutter movement speed of Example 3.

Example 2 will be described by utilizing the drawings. FIG. 17 is a graph which illustrates temperature distribution of the fixing nip portion in the longitudinal direction of Example 2. FIG. 18 is a graph which illustrates a movement condition of the shutter of Example 2. FIG. 19 is a table which expresses the relations between the shutter position and the shutter movement speed of Example 2.

As illustrated in FIG. 17, the peak position and the peak value of the temperature distribution at the non-sheet passing area vary in accordance with the cooling width and the sheet count during the fixing operation. The temperature distribution is illustrated in FIG. 17 by a solid line M1 at the time of passing of 200 LGL size sheets, by a solid line M2 at the time of passing of 50 LGL size sheets and by a solid line M3 at the time of passing of 200 LTR size sheets.

In the present example, a count portion which counts the number of the recording materials continuously conveyed to the fixing nip portion N after the print signal is received by the control circuit portion 100 is disposed in the control circuit portion 100. The shutter operation changing positions X, Y are appropriately laid in accordance with the sheet size and the shutter movement speed is changed in accordance with the passing sheet count which is counted by the count portion.

The characteristics of the movement of the shutter 44 are illustrated in FIG. 19 by a solid line M1 at the time of passing of 200 LGL size sheets, by a solid line M2 at the time of passing of 50 LGL size sheets and by a solid line M3 at the time of passing of 200 LTR size sheets. As illustrated by the solid line M1, when the sheet passing number is large and the peak temperature at the non-sheet passing area is high, the shutter 44 is moved slower compared with the case in which the sheet passing number is small so that sufficient cooling is performed.

In Example 2, similarly to Example 1, the shutter movement speed before the shutter operation changing position X and after the shutter operation changing position Y is faster than the shutter movement speed between passing through the shutter operation changing position X and arriving at the shutter operation changing position Y, as illustrated in FIG. 19. In addition, in Example 2, at each shutter position, the more the number of passing sheets, the slower the movement speed. Here, each parameter in this example may be changed in accordance with grange of a sheet, environmental temperature, job history and the like.

Example 3

Example 3 will be described by utilizing the drawing. FIG. 20 is a table which expresses the relations between the shutter position and the shutter movement speed of Example 3.

In Example 3, the movement condition of the shutter 44 is determined by detecting the heating member temperature at the non-sheet passing area which is the cooling area and the heating member temperature at the sheet passing area. Here, since the peak position of the temperature distribution at the non-sheet passing area varies in accordance with the cooling width during the fixing operation, the temperature of the non-sheet passing area has to be detected at a plurality of positions. In order to intensively cool the area where the temperature is highest, the shutter operation changing positions X, Y are appropriately laid in accordance with the position of the thermistor which detects the highest temperature. In this example, the shutter movement speed is changed in accordance with the peak temperature, as illustrated in FIG. 20.

In Example 3, similarly to the above-mentioned examples, the shutter movement speed before the shutter operation changing position X and after the shutter operation changing position Y is faster than the shutter movement speed between passing through the shutter operation changing position X and arriving at the shutter operation changing position Y, as illustrated in FIG. 20. In addition, in Example 3, at each shutter position, the higher the peak temperature T, the slower the movement speed.

Other Embodiments

The above-mentioned embodiment is configured to cool the heating member by the fan 41. However, the similar effects can be obtained by the configuration to cool the pressing member. Further, not limited to the above-mentioned heating apparatus of the film heating method, the heating apparatuses of the heat roller method and other structures can be utilized for the fixing mechanism portion 20A. Further, the fixing mechanism portion 20A can utilize the electro magnetic induction heating method. Furthermore, similar effects can be obtained with the fixing mechanism portion 20A which is configured to perform the sheet passing by the one side-based conveyance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-082446, filed Mar. 27, 2008, which is hereby incorporated by reference herein in its entirety.

What is claimed is:

1. An image heating apparatus comprising:

a heat rotating member which heats a toner image while nipping and conveying a recording material on which the toner image is borne;

a fan which cools the heat rotating member;

a blowing port which is arranged facing the heat rotating member and through which blowing air passes from the fan toward the heat rotating member;

a shutter which is movable in a longitudinal direction of the heat rotating member so as to change an opening area of the blowing port;

a control unit which moves the shutter in the longitudinal direction while rotating the fan after completion of a heating operation of the heat rotating member to the toner image; and a changing member which can change a movement speed of the shutter to a first movement speed of the shutter when obstructing the blowing air toward a first area of the heat rotating member at a first temperature and to a second movement speed of the shutter which is faster than the first movement speed when obstructing the blowing air toward a second area of the heat rotating member at a second temperature which is lower than the first temperature.

2. The image heating apparatus according to claim 1, wherein the temperature of the heat rotating member is a predetermined temperature.

3. An image heating apparatus comprising:

a heat rotating member which heats a toner image while nipping and conveying a recording material on which the toner image is borne;

a fan which cools the heat rotating member;

a blowing port which is arranged facing the heat rotating member and through which blowing air passes from the fan toward the heat rotating member;

a shutter which is movable in a longitudinal direction of the heat rotating member so as to change an opening area of the blowing port;

a control unit which moves the shutter in the longitudinal direction while rotating the fan after completion of a heating operation of the heat rotating member to the toner image; and a count unit which counts the number of the recording materials to which the heat rotating member continuously performs the heating operation, wherein the control unit sets the movement speed of the shutter slower in accordance with an increase of a count number of the count unit.

4. The image heating apparatus according to claim 3, wherein the temperature of the heat rotating member is a predetermined temperature.

* * * * *